US007787813B2

(12) United States Patent
Okaji

(10) Patent No.: US 7,787,813 B2
(45) Date of Patent: Aug. 31, 2010

(54) IMAGE FORMING APPARATUS CAPABLE OF STABLY CONVEYING RECORDING MEDIUM

(75) Inventor: Hiroyuki Okaji, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 609 days.

(21) Appl. No.: 11/555,893

(22) Filed: Nov. 2, 2006

(65) Prior Publication Data

US 2007/0110486 A1 May 17, 2007

(30) Foreign Application Priority Data

Nov. 2, 2005 (JP) ..... 2005-319734

(51) Int. Cl.
*G03G 15/16* (2006.01)
*G03G 15/08* (2006.01)

(52) U.S. Cl. ..... 399/316; 399/121

(58) Field of Classification Search ..... 399/316, 399/317, 110, 113, 121
See application file for complete search history.

(56) References Cited

U.S. PATENT DOCUMENTS

| | | | | |
|---|---|---|---|---|
| 4,929,982 | A * | 5/1990 | Ainoya et al. | 399/167 |
| 5,189,479 | A | 2/1993 | Matsuda et al. | |
| 5,719,684 | A | 2/1998 | Ohkaji et al. | |
| 5,758,247 | A * | 5/1998 | Yanashima et al. | 399/384 |
| 5,991,570 | A * | 11/1999 | Haga et al. | 399/114 |
| 6,134,404 | A * | 10/2000 | Iwai et al. | 399/110 |
| 6,144,811 | A | 11/2000 | Ohori et al. | |
| 6,160,969 | A | 12/2000 | Ishigaki et al. | |
| 6,628,903 | B1 | 9/2003 | Ohori et al. | |
| 6,898,383 | B2 | 5/2005 | Ohori et al. | |

FOREIGN PATENT DOCUMENTS

| | | |
|---|---|---|
| JP | 2000-112266 | 4/2000 |
| JP | 2000-155473 | 6/2000 |
| JP | 2005-017366 | 1/2005 |

OTHER PUBLICATIONS

Machine translation of reference Sato (JP 2000-112266) listed in IDS.*
Machine translation of reference Kimura (JP 2000-155473) listed in IDS.*
U.S. Appl. No. 11/971,580, filed Jan. 9, 2008, Kita, et al.

* cited by examiner

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

An image forming apparatus includes an image forming mechanism, a toner image carrier, a transfer unit, and a contact-separate mechanism. The image forming mechanism forms a toner image. The toner image carrier carries the toner image. The transfer unit includes a transferor, a pre-transfer guide, and a post-transfer guide. The transferor opposes the toner image carrier to form a transfer nip at which the toner image on the toner image carrier is transferred onto a recording medium. The pre-transfer guide and the post-transfer guide are respectively disposed on upstream and downstream sides from the transfer nip relative to a recording medium conveyance direction. The contact-separate mechanism moves the transfer unit including the transferor, the pre-transfer guide, and the post-transfer guide to contact and separate the transferor to and from the toner image carrier.

19 Claims, 5 Drawing Sheets

IMAGE FORMING APPARATUS CAPABLE OF STABLY CONVEYING RECORDING MEDIUM

CROSS-REFERENCE TO RELATED APPLICATION

The present application is based on and claims priority to Japanese patent application No. 2005-319734 filed on Nov. 2, 2005 in the Japan Patent Office, the entire contents of which are hereby incorporated herein by reference.

BACKGROUND OF THE INVENTION

1. Field of Invention

Exemplary aspects of the present invention relate to an image forming apparatus, and more particularly to an image forming apparatus including a contact-separate mechanism for contacting and separating a transferor to and from a toner image carrier.

2. Description of the Background

A related art image forming apparatus, such as a copying machine, a facsimile machine, a printer, or a multifunction printer having copying, printing, scanning, and facsimile functions, forms an electrostatic latent image on a photoconductor according to image data. The electrostatic latent image is developed with a developer (e.g., a toner) to form a toner image on the photoconductor. The toner image is transferred onto a recording medium (e.g., a sheet) and sent to a fixing unit. In the fixing unit, heat and pressure are applied to the sheet bearing the toner image to fix the toner image on the sheet.

The toner image formed on the photoconductor serving as a toner image carrier is directly transferred from the photoconductor onto a sheet as described above or indirectly transferred via another toner image carrier (i.e., an intermediate transfer member) onto a sheet. When the toner image is indirectly transferred via the intermediate transfer member, the toner image formed on the photoconductor is transferred onto the intermediate transfer member, and then further transferred from the intermediate transfer member onto the sheet. The toner image carrier opposes a transfer roller to form a transfer nip at which the toner image is transferred from the toner image carrier onto the sheet. Specifically, the toner image carrier and the transfer roller rotate to feed the sheet while the toner image is transferred onto the sheet.

The transfer roller contacts the toner image carrier when the transfer roller is not configured to separate from the toner image carrier while the sheet is not conveyed through the transfer nip. As a result, a residual toner remaining on the rotating toner image carrier may be adhered to the transfer roller. The adhered toner may be further adhered to the backside of a sheet conveyed to the transfer nip. When the toner image carrier and the transfer roller stop rotating for a substantial time period while the toner image carrier contacts the transfer roller, the toner image carrier and the transfer roller may be deformed.

To address the above-described problems, the related art image forming apparatus can include a contact-separate mechanism for contacting and separating the transfer roller to and from the toner image carrier as needed. For example, one example image forming apparatus includes a contact-separate mechanism for contacting and separating a transfer roller to and from an intermediate transfer belt (i.e., the toner image carrier). The example image forming apparatus further includes an upstream guide to guide a sheet to the transfer nip. The upstream guide is disposed on an upstream side from the transfer nip formed between the intermediate transfer belt and the transfer roller relative to a sheet conveyance direction. However, the upstream guide may be unstably positioned with respect to the transfer roller when only the transfer roller is moved to contact and separate to and from the intermediate transfer belt. As a result, the sheet may not be stably conveyed and may be jammed.

To address the above-described problem in the example image forming apparatus, the upstream guide and the transfer roller are moved together so that the transfer roller contacts and separates to and from the intermediate transfer belt. Thus, the position of the upstream guide with respect to the transfer roller is fixed even when the transfer roller is moved to contact and separate to and from the intermediate transfer belt. As a result, the sheet can be stably conveyed on the upstream side from the transfer nip relative to the sheet conveyance direction, thereby preventing the sheet from being jammed.

In the example image forming apparatus, a downstream guide is disposed on a downstream side from the transfer nip relative to the sheet conveyance direction to guide the sheet toward a fixing unit. However, the position of the downstream guide with respect to the transfer roller is not fixed. Therefore, the sheet may be unstably conveyed on the downstream side from the transfer nip relative to the sheet conveyance direction and may be jammed. The sheet, which has passed the transfer nip, bears an unfixed toner image. When the sheet is jammed on the downstream side from the transfer nip relative to the sheet conveyance direction, toner particles forming the unfixed toner image may scatter from the sheet and thereby may stain the interior of the image forming apparatus.

SUMMARY OF THE INVENTION

According to an aspect of the present invention, an image forming apparatus is provided. In one aspect of the present invention, the image forming apparatus includes an image forming mechanism, a toner image carrier, a transfer unit, and a contact-separate mechanism. The image forming mechanism forms a toner image. The toner image carrier carries the toner image. The transfer unit includes a transferor, a pre-transfer guide, and a post-transfer guide. The transferor opposes the toner image carrier to form a transfer nip at which the toner image on the toner image carrier is transferred onto a recording medium. The pre-transfer guide is disposed on an upstream side from the transfer nip relative to a recording medium conveyance direction. The post-transfer guide is disposed on a downstream side from the transfer nip relative to the recording medium conveyance direction. The contact-separate mechanism moves the transfer unit including the transferor, the pre-transfer guide, and the post-transfer guide to contact and separate the transferor to and from the toner image carrier.

In another aspect of the present invention, the image forming apparatus includes an image forming mechanism, a transfer unit, and a contact-separate mechanism. The image forming mechanism forms a toner image. The transfer unit includes a transferor, a pre-transfer guide, and a post-transfer guide. The transferor opposes the image forming mechanism to form a transfer nip at which the toner image on the image forming mechanism is transferred onto a recording medium. The pre-transfer guide is disposed on an upstream side from the transfer nip relative to a recording medium conveyance direction. The post-transfer guide is disposed on a downstream side from the transfer nip relative to the recording medium conveyance direction. The contact-separate mechanism moves the transfer unit including the transferor, the pre-transfer guide, and the post-transfer guide to contact and separate the transferor to and from the image forming mechanism.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
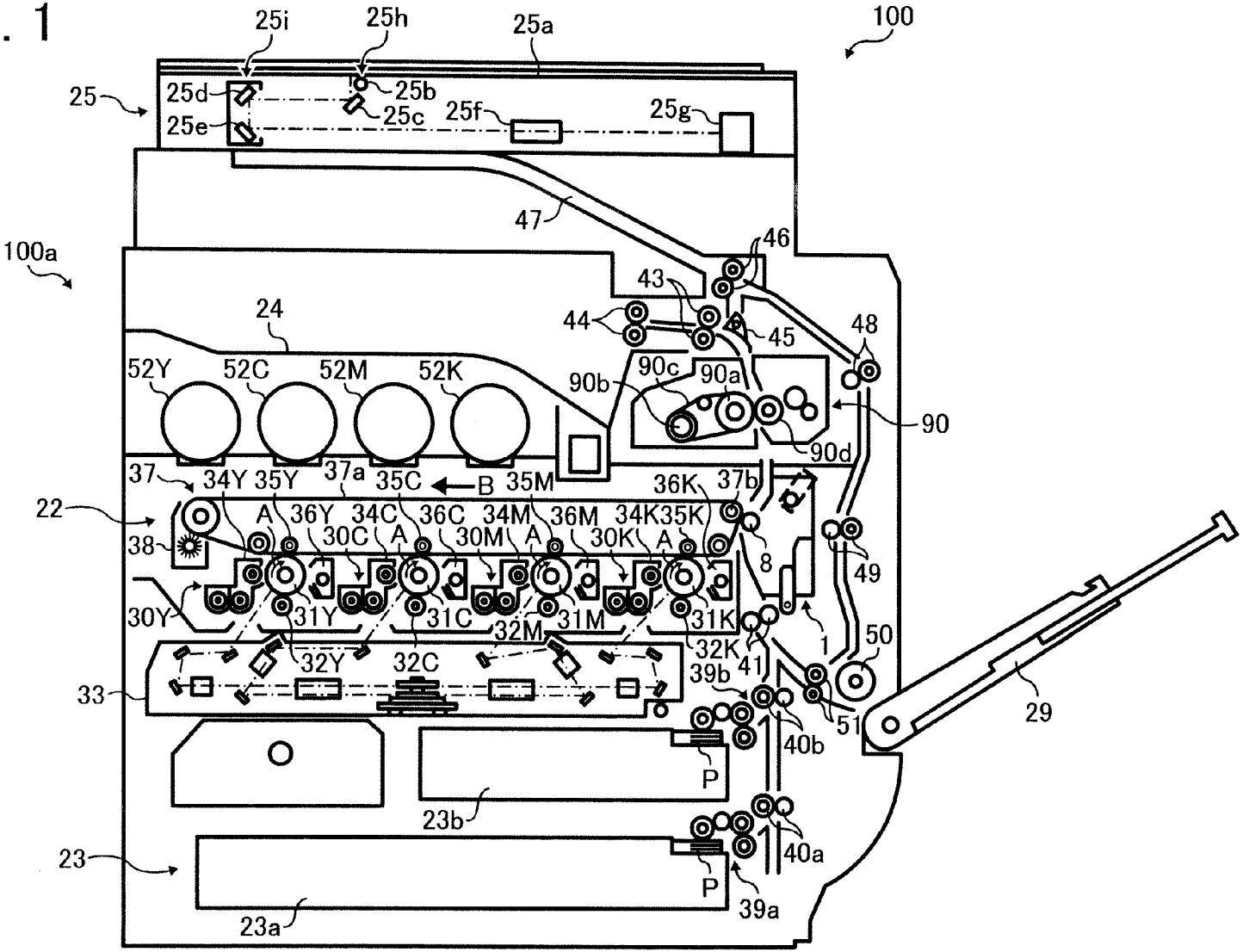
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes an image reader 25 and a main body 100*a*. The image reader 25 includes an exposure glass 25*a*, a first scanning body 25*h*, a second scanning body 25*i*, a lens 25*f*, and an image sensor 25*g*. The first scanning body 25*h* includes a light source 25*b* and a first mirror 25*c*. The second scanning body 25*i* includes a second mirror 25*d* and a third mirror 25*e*. The main body 10*a* includes a printing unit 22, toner bottles 52Y, 52C, 52M, and 52K, a paper tray unit 23, a first feeder 39*a*, a second feeder 39*b*, a first conveying roller pair 40*a*, a second conveying roller pair 40*b*, a bypass tray 29, a feeding roller 50, a conveying roller pair 51, a registration roller pair 41, a second transfer unit 1, a fixing unit 90, a conveying roller pair 43, an output roller pair 44, an output tray 24, a switching nail 45, a reverse conveying roller pair 46, a reverse conveying path 47, a first duplex conveying roller pair 48, and a second duplex conveying roller pair 49.

The printing unit 22 includes an optical writer 33, image forming units 30Y, 30C, 30M, and 30K, and an intermediate transfer unit 37. The image forming unit 30Y includes a photoconductor 31Y, a charger 32Y, a development unit 34Y, and a cleaner 36Y. The image forming unit 30C includes a photoconductor 31C, a charger 32C, a development unit 34C, and a cleaner 36C. The image forming unit 30M includes a photoconductor 31M, a charger 32M, a development unit 34M, and a cleaner 36M. The image forming unit 30K includes a photoconductor 31K, a charger 32K, a development unit 34K, and a cleaner 36K. The intermediate transfer unit 37 includes an intermediate transfer belt 37*a*, first transfer rollers 35Y, 35C, 35M, and 35K, a support roller 37*b*, and a belt cleaner 38. The paper tray unit 23 includes a first paper tray 23*a* and a second paper tray 23*b*. The second transfer unit 1 includes a second transfer roller 8. The fixing unit 90 includes a fixing roller 90*a*, a heating roller 90*b*, a fixing belt 90*c*, and a pressing roller 90*d*.

The image forming apparatus 100 may be a copying machine, a facsimile machine, a printer, a multifunction printer including copying, printing, scanning, and facsimile functions, or the like. According to one non-limiting exemplary embodiment of the present invention, the image forming apparatus 100 functions as a color copying machine for forming a color image on a recording medium by an electrophotographic method.

The image reader 25 is disposed on the main body 100*a* and scans an image on an original sheet to create image data. The image reader 25 further includes an exposure glass cover (not shown) or an auto document feeder (ADF) (not shown). The exposure glass cover is disposed on the exposure glass 25*a* and presses the original sheet placed on the exposure glass 25*a*. The ADF is disposed on the exposure glass 25*a*. When the exposure glass cover is disposed on the exposure glass 25*a*, a user lifts the exposure glass cover, places an original sheet on the exposure glass 25*a*, and then lowers the exposure glass cover. When the ADF is disposed on the exposure glass 25*a*, the user places original sheets on the ADF. When the original sheet is placed on the exposure glass 25*a*, the image reader 25 is driven immediately after the user presses a start button on a control panel (not shown) of the image forming apparatus 100. When the original sheets are placed on the ADF, the ADF automatically feeds the original sheets one by one onto the exposure glass 25*a*. The image reader 25 is then driven after the user presses the start button on the control panel.

When the image reader 25 is driven, the first scanning body 25*h* and the second scanning body 25*i* move. The light source 25*b* emits light onto the original sheet. The first mirror 25*c* deflects the light reflected by the original sheet toward the second mirror 25*d*. The second mirror 25*d* further deflects the light deflected by the first mirror 25*c* toward the third mirror 25*e*. The third mirror 25*e* further deflects the light deflected by the second mirror 25*d* toward the lens 25*f*. The lens 25*f* emits the light deflected by the third mirror 25*e* toward the image sensor 25*g* to form an image. The image sensor 25*g* includes a CCD (charge-coupled device) and is disposed at an image forming position to read the image. When the user selects a full-color mode, a monochrome mode, or an automatic mode on the control panel, an image forming operation is performed according to the read image data.

The printing unit 22 is disposed in a middle portion of the main body 100*a* and under the image reader 25, and forms a toner image according to the image data created by the image reader 25. The image forming units 30Y, 30C, 30M, and 30K, each serving as an image forming mechanism, respectively form toner images in yellow, cyan, magenta, and black colors. The image forming units 30Y, 30C, 30M, and 30K have a common structure. The photoconductors 31Y, 31C, 31M, and 31K rotate in a rotating direction A. The chargers 32Y, 32C, 32M, and 32K, the development units 34Y, 34C, 34M, and 34K, the first transfer rollers 35Y, 35C, 35M, and 35K, and the cleaners 36Y, 36C, 36M, and 36K are respectively disposed around the photoconductors 31Y, 31C, 31M, and 31K.

The optical writer 33 is disposed under the image forming units 30Y, 30C, 30M, and 30K. The optical writer 33 includes four light sources (not shown), four collimating optical systems (not shown), one deflecting system (not shown), and four optical systems (not shown). The four light sources correspond to the photoconductors 31Y, 31C, 31M, and 31K and emit luminous flux by an LD (laser diode) method. The collimating optical systems collimate the luminous flux emitted by the light sources. The deflecting system includes a polygon mirror (not shown) and a polygon motor (not shown), and can be a polygon scanner. Each of the optical systems includes lenses (e.g., an fθ lens) for scanning, forming, and correcting an image; and mirrors, which are disposed on an optical path originating from each of the light sources. The polygon scanner deflects laser beams emitted from the laser diode according to image data corresponding to the yellow, cyan, magenta, and black colors to scan in four directions toward the photoconductors 31Y, 31C, 31M, and 31K.

The chargers 32Y, 32C, 32M, and 32K uniformly charge surfaces of the photoconductors 31Y, 31C, 31M, and 31K respectively. The laser beams deflected by the polygon scanner of the optical writer 33 are respectively emitted onto the charged surfaces of the photoconductors 31Y, 31C, 31M, and 31K. Thus, an electrostatic latent image is formed on each of the photoconductors 31Y, 31C, 31M, and 31K.

The toner bottles 52Y, 52C, 52M, and 52K are disposed under the output tray 24 and above the printing unit 22. The toner bottles 52Y, 52C, 52M, and 52K respectively contain yellow, cyan, magenta, and black toners and respectively supply the yellow, cyan, magenta, and black toners in a predetermined amount to the development units 34Y, 34C, 34M, and 34K via conveyance routes (not shown). The development units 34Y, 34C, 34M, and 34K respectively develop the electrostatic latent images formed on the photoconductors 31Y, 31C, 31M, and 31K with the yellow, cyan, magenta, and black toners. Thus, yellow, cyan, magenta, and black toner images are respectively formed on the surfaces of the photoconductors 31Y, 31C, 31M, and 31K.

The intermediate transfer unit 37, serving as a toner image carrier unit, is disposed above the image forming units 30Y, 30C, 30M, and 30K. A driving roller (not shown), a driven roller (not shown), the first transfer rollers 35Y, 35C, 35M, and 35K, and the support roller 37*b* rotatably support the intermediate transfer belt 37*a*. The intermediate transfer belt 37*a*, serving as a toner image carrier and an intermediate transfer member, has an endless belt shape and rotates in a rotating direction B. The belt cleaner 38 is disposed near one horizontal end of the intermediate transfer belt 37*a* in the rotating direction B. The second transfer unit 1, serving as a transfer unit, is disposed near another horizontal end of the intermediate transfer belt 37*a* in the rotating direction B. The second transfer roller 8, serving as a transferor, opposes the support roller 37*b* via the intermediate transfer belt 37*a*, so that a second transfer nip is formed between the second transfer roller 8 and the intermediate transfer belt 37*a*. An outer circumferential surface of the second transfer roller 8 contacts an outer circumferential surface of the intermediate transfer belt 37*a*. Therefore, the second transfer roller 8 is rotated by the rotating intermediate transfer belt 37*a*.

A first transfer voltage is applied to each of the first transfer rollers 35Y, 35C, 35M, and 35K to perform a first transfer, that is, to transfer the yellow, cyan, magenta, and black toner images respectively formed on the photoconductors 31Y, 31C, 31M, and 31K onto the outer circumferential surface of the intermediate transfer belt 37*a*. The yellow, cyan, magenta, and black toner images are transferred at different timings, so that the yellow, cyan, magenta, and black toner images are superimposed on a common position on the outer circumferential surface of the intermediate transfer belt 37*a*. Specifically, the yellow toner image is transferred from the photoconductor 31Y disposed on an upstream side from the photoconductors 31C, 31M, and 31K relative to the rotating direction B, and then the cyan, magenta, and black toner images are respectively transferred in this order from the photoconductors 31C, 31M, and 31K.

The paper tray unit 23 is disposed in a lower portion of the main body 100*a* and loads a recording medium (e.g., sheets P). The first paper tray 23*a*, the second paper tray 23*b*, and the bypass tray 29 load sheets P. One of the first feeder 39*a*, the second feeder 39*b*, and the feeding roller 50 feeds a sheet P from the first paper tray 23*a*, the second paper tray 23*b*, or the bypass tray 29 in accordance with the timings of the first transfer. When the first feeder 39*a* feeds the sheet P, the first conveying roller pair 40*a* and the second conveying roller pair 40*b* further feed the sheet P toward the registration roller pair 41. When the second feeder 39*b* feeds the sheet P, the second conveying roller pair 40*b* further feed the sheet P toward the registration roller pair 41. When the feeding roller 50 feeds the sheet P, the conveying roller pair 51 further feeds the sheet P toward the registration roller pair 41. The registration roller pair 41 feeds the sheet P toward the second transfer unit 1 at a predetermined timing.

When a foremost head of the sheet P reaches the registration roller pair 41, a sensor (not shown) detects the sheet P and outputs a detection signal. The registration roller pair 41 feeds the sheet P to the second transfer nip at a proper timing in accordance with the detection signal.

The second transfer roller 8 performs a second transfer to transfer the yellow, cyan, magenta, and black toner images superimposed on the outer circumferential surface of the intermediate transfer belt 37*a* onto the sheet P at the second transfer nip. Thus, a color toner image is formed on the sheet P. The second transfer roller 8 and the intermediate transfer belt 37*a* feed the sheet P bearing the color toner image toward the fixing unit 90.

The fixing unit 90 is disposed above the second transfer unit 1. The fixing roller 90*a* and the heating roller 90*b* support the fixing belt 90*c*. The pressing roller 90*d* pressingly contacts the fixing belt 90*c*. The fixing belt 90*c* and the pressing roller 90*d* apply heat and pressure to the sheet P to fix the color toner image on the sheet P. The fixing belt 90*c* and the pressing roller 90*d* feed the sheet P toward the conveying roller pair 43.

The conveying roller pair 43 and the output roller pair 44 are disposed above the fixing unit 90. The conveying roller pair 43 feeds the sheet P toward the output roller pair 44. The output roller pair 44 feeds and outputs the sheet P onto the output tray 24. The output tray 24 is disposed under the image reader 25 and receives the sheet P bearing the fixed color toner image fed by the output roller pair 44. Thus, the user can pick up the sheet P bearing the fixed color toner image on its front side.

The switching nail 45, the reverse conveying roller pair 46, and the reverse conveying path 47 are disposed above the conveying roller pair 43 and the output roller pair 44. When the user selects a duplex copy mode on the control panel, the switching nail 45 moves to guide the sheet P toward the reverse conveying roller pair 46. The reverse conveying roller pair 46 feeds the sheet P toward the reverse conveying path 47. When the sheet P is conveyed to the reverse conveying path 47, the sheet P temporarily stops on the reverse conveying path 47. The reverse conveying roller pair 46 rotates in an opposite direction to feed the sheet P toward the first duplex conveying roller pair 48. The first duplex conveying roller pair 48 further feeds the sheet P toward the second duplex conveying roller pair 49. The second duplex conveying roller pair 49 further feeds the sheet P toward the registration roller pair 41. The registration roller pair 41 feeds the sheet P toward the second transfer nip again. At the second transfer nip, the second transfer roller 8 transfers toner images superimposed on the outer circumferential surface of the intermediate transfer belt 37*a* onto the backside of the sheet P to form a color toner image on the sheet P. The sheet P bearing the color toner image is conveyed to the fixing unit 90 in which the fixing belt 90*c* and the pressing roller 90*d* apply heat and pressure to the sheet P to fix the color toner image on the backside of the sheet P. The sheet P bearing the fixed color toner image is conveyed toward the conveying roller pair 43. The conveying roller pair 43 feeds the sheet P toward the output roller pair 44. The output roller pair 44 feeds and outputs the sheet P onto the output tray 24. Thus, the user can pick up the sheet P bearing the fixed color toner image on its both sides.

The cleaners 36Y, 36C, 36M, and 36K respectively remove residual toners remaining on the surfaces of the photoconductors 31Y, 31C, 31M, and 31K. Then, the chargers 32Y, 32C, 32M, and 32K, in which an alternating current bias is applied and superimposed on a direct current bias, simultaneously discharge and charge the surfaces of the photoconductors 31Y, 31C, 31M, and 31K respectively. The belt cleaner 38 removes a residual toner remaining on the outer circumferential surface of the intermediate transfer belt 37*a*. Thus, the image forming apparatus 100 becomes ready for a next image forming operation.

The image forming apparatus 100 may include an image forming unit having a structure different from the above-described structure of the image forming units 30Y, 30C, 30M, and 30K (i.e., a tandem type image forming unit). For example, according to another embodiment, the image forming apparatus 100 may include an image forming unit including a single photoconductor, a plurality of development units, and a single intermediate transfer belt to form a color toner image by a single drum intermediate transfer method. Alternatively, the image forming apparatus 100 may include an image forming unit which forms a monochrome toner image. The image forming apparatus 100 may not include the image reader 25. In this case, the image forming apparatus 100 functions as a printer.

Figure 2:
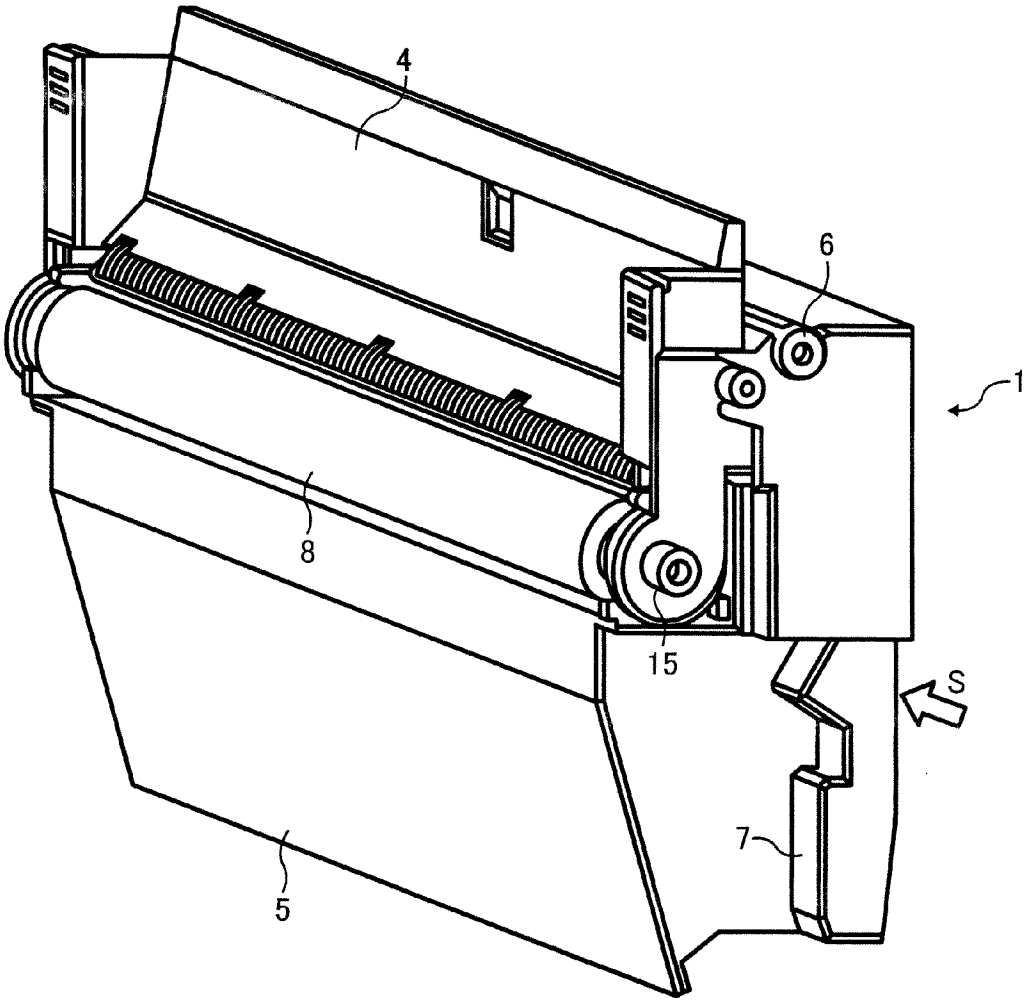
FIG. 2 is a perspective view of a second transfer unit of the image forming apparatus shown in FIG. 1.
Figure 3:
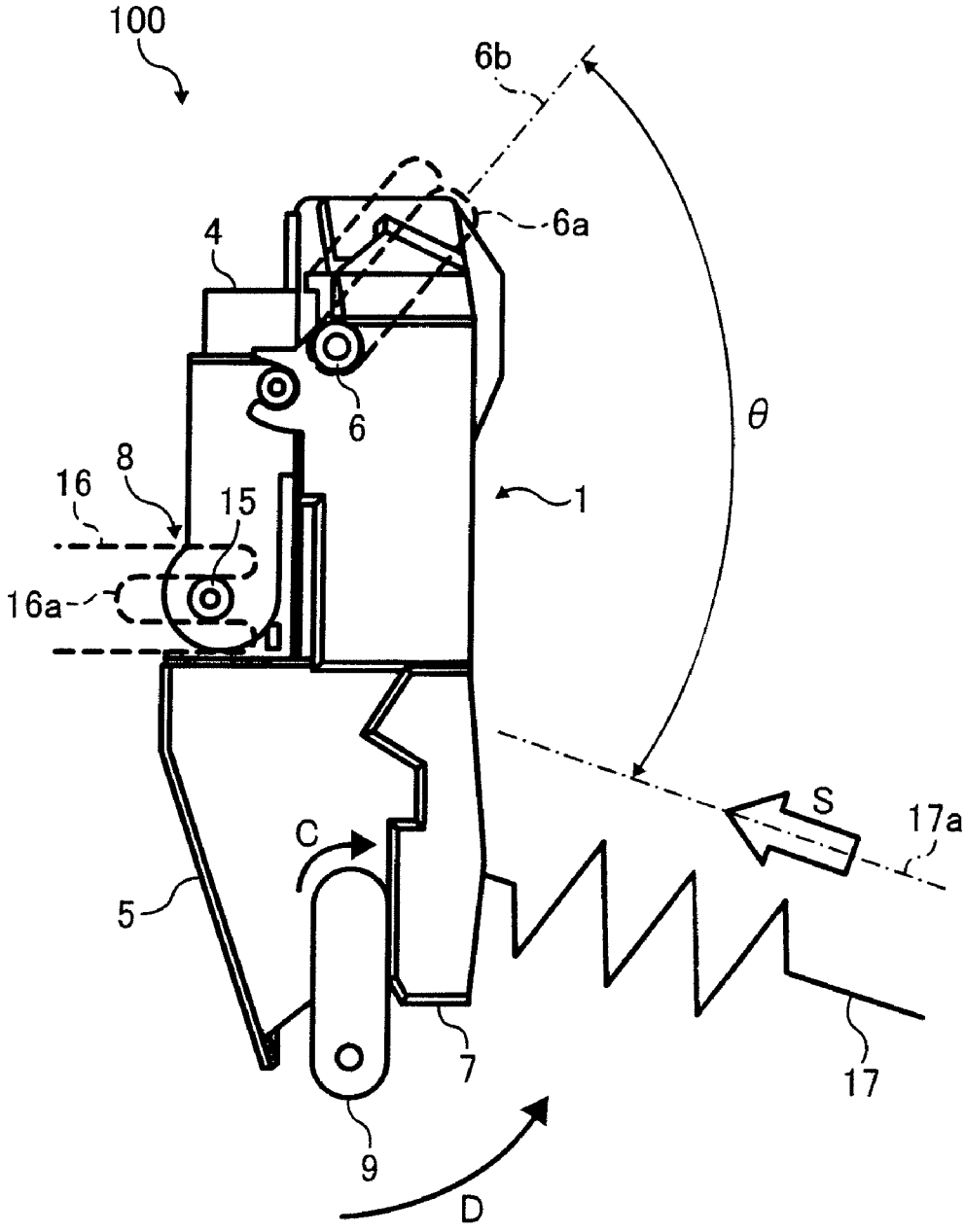
FIG. 3 is a sectional view of the second transfer unit shown in FIG. 2.

FIG. 2 is a perspective view of the second transfer unit 1. FIG. 3 is a sectional view of the second transfer unit 1. As illustrated in FIGS. 2 and 3, the second transfer unit 1 further includes a pre-transfer guide 5, a post-transfer guide 4, a positioning member 15, a pivot 6, a lever 9, and a lever receiver 7. As illustrated in FIG. 3, the image forming apparatus 100 further includes a positioning member 16, a spring 17, and an elongate hole 6*a*. The positioning member 16 includes an innermost end 16*a*.

The pre-transfer guide 5, the post-transfer guide 4, and the second transfer roller 8 are integrally supported in the second transfer unit 1. The pre-transfer guide 5 guides the sheet P fed by the registration roller pair 41 to the second transfer roller 8. The post-transfer guide 4 guides the sheet P fed by the second transfer roller 8 toward the fixing unit 90. The positioning member 15 is disposed on one end of a rotating shaft of the second transfer roller 8 in a longitudinal direction of the second transfer roller 8, and fixes the position of the second transfer roller 8 in the image forming apparatus 100 in a sheet conveyance direction (i.e., a vertical direction according to this non-limiting exemplary embodiment). The positioning member 16, which is illustrated in the broken line in FIG. 3, is disposed in the main body 100*a* of the image forming apparatus 100 and is engaged with the positioning member 15. The positioning member 16 has a shape which allows the positioning member 15, when engaged with the positioning member 16, to be movable in a horizontal direction but not movable in the vertical direction. The second transfer unit 1 uses the positioning members 15 and 16 to change its position with respect to the intermediate transfer belt 37*a*. Namely, the second transfer unit 1 moves to contact and separate the second transfer roller 8 to and from the intermediate transfer belt 37*a*. The structure for positioning the second transfer roller 8 is not limited to the structure illustrated in FIGS. 2 and 3 as long as the structure positions the second transfer roller 8 in the image forming apparatus 100. The positioning member 16 may be provided in the intermediate transfer unit 37.

Referring to FIG. 3, the following describes a contact-separate mechanism for contacting and separating the second transfer roller 8 to and from the intermediate transfer belt 37*a*.

The pivot 6 is disposed in an upper portion of the second transfer unit 1 and is used as an axis for rotating the second transfer unit 1. The spring 17, which forms the contact-separate mechanism, is disposed near a lower portion of the second transfer unit 1 and applies pressure to the lever receiver 7. The lever 9 rotates to apply pressure to the lever receiver 7 so as to separate the second transfer roller 8 from the intermediate transfer belt 37*a*. The lever receiver 7 receives pressure applied by the lever 9 and serves as an application point to which the contact-separate mechanism applies a force for contacting and separating the second transfer roller 8 to and from the intermediate transfer belt 37*a*. The second transfer roller 8 is disposed between the pivot 6 and the lever receiver 7.

When the lever 9 does not apply pressure to the lever receiver 7, the spring 17 applies pressure in a direction S to cause the second transfer roller 8 to contact the intermediate transfer belt 37*a*. In contrast, when a driver (not shown) rotates the lever 9 in a rotating direction C, the lever 9 presses the lever receiver 7 to rotate the second transfer unit 1 in a rotating direction D around the pivot 6. Accordingly, the second transfer roller 8 separates from the intermediate transfer belt 37*a*.

To prevent formation of a rough toner image, the second transfer roller 8 needs to apply a large pressure to the intermediate transfer belt 37*a*. For example, in a background image forming apparatus, a second transfer roller directly applies pressure toward a second transfer nip with a force equivalent to a load of the second transfer nip. Therefore, a greater pressure is needed to contact and separate a second transfer unit to and from an intermediate transfer belt. As a result, a large size image forming apparatus is manufactured at increased costs.

In the image forming apparatus 100 of this embodiment, the lever receiver 7 (i.e., an application point to which the contact-separate mechanism applies a force for contacting and separating the second transfer roller 8 to and from the intermediate transfer belt 37*a*) is disposed in the lower portion of the second transfer unit 1. Namely, the lever receiver 7 is disposed farther from the pivot 6 than the second transfer roller 8. Therefore, the spring 17 can apply a pressure smaller than the load of the second transfer nip to contact and separate the second transfer roller 8 to and from the intermediate transfer belt 37*a*. The second transfer roller 8 can apply a pressure smaller than the pressure directly applied toward the second transfer nip in the background image forming apparatus. As a result, a smaller size image forming apparatus can be manufactured at decreased costs.

The elongate hole 6*a*, which forms the contact-separate mechanism, is disposed in the main body 100*a* of the image forming apparatus 100 and engages with the pivot 6. The elongate hole 6*a* has a slit-like shape in which the engaged pivot 6 is movable in a longitudinal direction of the elongate hole 6*a*. The elongate hole 6*a* has a width, which extends in a direction perpendicular to the longitudinal direction, corresponding to the diameter of the pivot 6. Thus, the second transfer unit 1 can rotate around the pivot 6.

A line 6*b* indicated by the alternate long and short dashed lines extends in the longitudinal direction of the elongate hole 6*a*. A line 17*a* indicated by the alternate long and short dashed lines extends in the direction S in which the spring 17 applies pressure to the lever receiver 7. The lines 6*b* and 17*a* form an angle θ in a range of from about 60 degrees to about 120 degrees. Thus, when the spring 17 applies pressure to the second transfer unit 1, the pivot 6 does not move in the elongate hole 6*a*. According to this non-limiting exemplary embodiment, the angle θ is about 90 degrees. Thus, the spring 17 does not apply pressure in the longitudinal direction of the elongate hole 6*a*, preventing pressure applied by the spring 17 from moving the pivot 6 in the elongate hole 6*a* with an improved accuracy.

The positioning members 15 and 16 position the pivot 6 to engage with the elongate hole 6*a* such that the pivot 6 moves in the elongate hole 6*a* in the longitudinal direction of the elongate hole 6*a*.

The contact-separate mechanism for contacting and separating the second transfer roller 8 to and from the intermediate transfer belt 37*a* is not limited to the mechanism as described above or illustrated in FIG. 3 as long as the second transfer unit 1 is moved to contact and separate the second transfer roller 8 to and from the intermediate transfer belt 37*a*.

Pressure applied by the spring 17 causes the second transfer roller 8 to press the support roller 37*b* via the intermediate transfer belt 37*a*. Thus, the second transfer nip is formed between the second transfer roller 8 and the intermediate transfer belt 37*a*.

The innermost end 16*a* is disposed at an innermost end of a cave formed by the positioning member 16 and in which the positioning member 15 moves. When the spring 17 applies pressure to the second transfer unit 1, the positioning member 15 contacts the innermost end 16*a* to position the second transfer roller 8 with respect to the intermediate transfer belt 37*a*. Thus, the second transfer nip having a predetermined length can be formed.

The second transfer roller 8 may be positioned with respect to the intermediate transfer belt 37*a* by contacting the second transfer roller 8 to the intermediate transfer belt 37*a*. In this case, the innermost end 16*a* is provided at the position where the positioning member 15 does not contact the innermost end 16*a* even when the second transfer roller 8 contacts the intermediate transfer belt 37*a*.

As described above, the second transfer unit 1 is moved to contact and separate the second transfer roller 8 to and from the intermediate transfer belt 37*a*. Therefore, the positions of the pre-transfer guide 5 and the post-transfer guide 4 are fixed with respect to the second transfer roller 8. Thus, the sheet P is stably conveyed on both upstream and downstream sides from the second transfer nip relative to the sheet conveyance direction. Namely, even when the second transfer roller 8 is configured to be movable to contact and separate to and from the intermediate transfer belt 37*a*, the sheet P can be stably conveyed.

In a background image forming apparatus using an intermediate transfer method, a reference image is formed on an outer circumferential surface of an intermediate transfer belt and the reference image is detected to control image forming operations. However, the background image forming apparatus cannot accurately detect the reference image while a second transfer roller contacts the intermediate transfer belt.

In the image forming apparatus 100 of this embodiment, in which the second transfer roller 8 can contact and separate to and from the intermediate transfer belt 37*a*, this problem can be solved. Namely, operations of contacting and separating the second transfer roller 8 to and from the intermediate transfer belt 37*a* can more effectively transfer toner images superimposed on the intermediate transfer belt 37*a* onto a sheet P. In addition, image forming processes can be controlled based on detection of a reference image formed on the intermediate transfer belt 37*a*.

Figure 4:
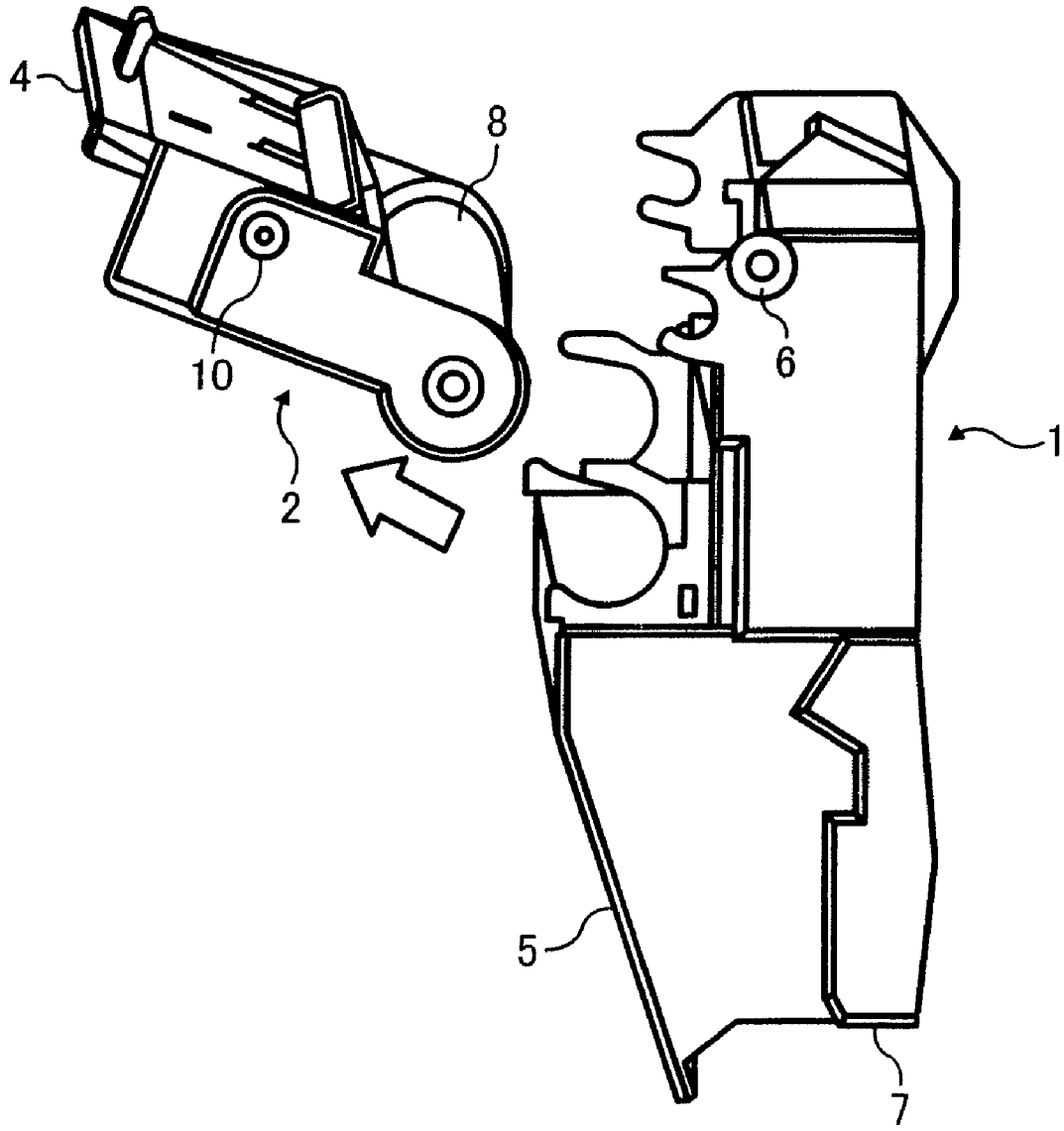
FIG. 4 is a sectional view of the second transfer unit shown in FIG. 3 from which a consumable unit is removed.

As illustrated in FIG. 4, the second transfer unit 1 further includes a consumable unit 2. The consumable unit 2 includes the second transfer roller 8, the post-transfer guide 4, and a shaft 10. The consumable unit 2 is attachable and detachable to and from the second transfer unit 1. FIG. 4 illustrates the consumable unit 2 detached from the second transfer unit 1. The consumable unit 2 is attached to the second transfer unit 1 by using the shaft 10 and the rotating shaft of the second transfer roller 8.

The second transfer roller 8 has a shorter life than the pre-transfer guide 5 and the post-transfer guide 4 and thereby needs to be replaced more frequently than the pre-transfer guide 5 and the post-transfer guide 4. However, replacing the entire second transfer unit 1 including the pre-transfer guide 5 and the post-transfer guide 4 increases running costs. If the consumable unit 2 including the second transfer roller 8 is configured to be attachable and detachable to and from the second transfer unit 1 as illustrated in FIG. 4, only the consumable unit 2 can be removed for replacement, resulting in reduced running costs. The structure for attaching the consumable unit 2 to the second transfer unit 1 is not limited to the structure as described above or illustrated in FIG. 4.

As described above, the second transfer nip is formed with consumables such as the second transfer roller 8. In a background image forming apparatus, only the consumables are configured to be attachable and detachable to and from the image forming apparatus and a second transfer roller is positioned with respect to an intermediate transfer belt by using the consumables only. Therefore, sheet conveying paths respectively disposed on upstream and downstream sides from a second transfer nip relative to a sheet conveyance direction are not stably positioned with respect to the second transfer nip, thereby resulting in unstable conveyance of a sheet.

According to one embodiment, in the image forming apparatus 100, the consumable unit 2 can be removed for replacement. However, the second transfer roller 8 is positioned with respect to the intermediate transfer belt 37*a* by using the consumable unit 2 and the other elements of the second transfer unit 1. Thus, the sheet conveying paths respectively disposed on the upstream and downstream sides from the second transfer nip relative to the sheet conveyance direction are stably positioned with respect to the second transfer nip, thereby resulting in stable conveyance of a sheet P.

As described above, according to this non-limiting exemplary embodiment, the pre-transfer guide 5, the post-transfer guide 4, and the second transfer roller 8 are integrally supported in the second transfer unit 1 so as to move together in order to contact and separate the second transfer roller 8 to and from the intermediate transfer belt 37*a*. Thus, the positions of the pre-transfer guide 5 and the post-transfer guide 4 with respect to the second transfer roller 8 are fixed. As a result, a sheet P is stably conveyed in the sheet conveying paths respectively disposed on the upstream and downstream sides from the second transfer nip relative to the sheet conveyance direction. Namely, even when the second transfer roller 8 is configured to be movable to contact and separate to and from the intermediate transfer belt 37*a*, the sheet P can be stably conveyed.

The consumable unit 2 including consumables such as the second transfer roller 8 is attachable and detachable to and from the second transfer unit 1. Thus, a user need only replace the consumable unit 2 with a new one, resulting in decreased running costs.

The second transfer unit 1 includes the pivot 6 serving as an axis at one end thereof and the lever receiver 7 serving as an application point to which the contact-separate mechanism applies a force for contacting and separating the second transfer roller 8 to and from the intermediate transfer belt 37*a* at the other end thereof. The second transfer roller 8 is disposed between the pivot 6 and the lever receiver 7. Thus, the spring 17 can apply a smaller pressure to contact the second transfer roller 8 to the intermediate transfer belt 37*a*, and the lever 9 can apply a smaller force to separate the second transfer roller 8 from the intermediate transfer belt 37*a*. As a result, a load applied to the image forming apparatus 100 can be reduced, and thereby the image forming apparatus 100, which has a compact size, and thereby, the image forming apparatus can be manufactured at decreased production costs.

The elongate hole 6*a* has a slit-like shape in which the pivot 6 is movable in the longitudinal direction of the elongate hole 6*a*. A line extending in the longitudinal direction of the elongate hole 6*a* (i.e., the line 6*b* in FIG. 3) and a line extending in a direction of a force for contacting and separating the second transfer roller 8 to and from the intermediate transfer belt 37*a* (i.e., the line 17*a* in FIG. 3) form the angle θ in a range of from about 60 degrees to about 120 degrees. Thus, when the spring 17 applies pressure to the second transfer unit 1, the pivot 6 does not move in the elongate hole 6*a*. As a result, the second transfer unit 1 can be properly positioned in the image forming apparatus 100 and a load applied to the second transfer nip can be adjusted.

The positioning member 16 for positioning the second transfer roller 8 with respect to the intermediate transfer belt 37*a* is provided in the intermediate transfer unit 37 (i.e., a toner image carrier unit attachable and detachable to and from the image forming apparatus 100). Thus, the second transfer roller 8 can be properly positioned with respect to the intermediate transfer belt 37*a*. As a result, toner images formed on the intermediate transfer belt 37*a* can be properly transferred onto a sheet P.

Alternatively, the positioning member 16 may be provided in an element other than the intermediate transfer unit 37 in the main body 100*a* of the image forming apparatus 100. Thus, the second transfer roller 8 can be properly positioned in the image forming apparatus 100. When the intermediate transfer unit 37 is properly set in the image forming apparatus 100, the second transfer roller 8 is properly positioned with respect to the intermediate transfer belt 37*a*. As a result, toner images formed on the intermediate transfer belt 37*a* can be properly transferred onto a sheet P.

To set the second transfer unit 1 in the image forming apparatus 100, the second transfer unit 1 is properly positioned with respect to the intermediate transfer unit 37 by the positioning member 15 (i.e., an element other than the second transfer roller 8 provided in the second transfer unit 1) contacting the positioning member 16 (i.e., an element other than the intermediate transfer belt 37*a* provided in the intermediate transfer unit 37 or other element in the image forming apparatus 100). Thus, toner images formed on the intermediate transfer belt 37*a* can be properly transferred onto a sheet P.

Alternatively, to set the second transfer unit 1 in the image forming apparatus 100, the second transfer roller 8 may be properly positioned with respect to the intermediate transfer belt 37*a* by contacting the second transfer roller 8 to the intermediate transfer belt 37*a*. Thus, toner images formed on the intermediate transfer belt 37*a* can be properly transferred onto a sheet P.

The outer circumferential surface of the second transfer roller 8, which has a roller shape, contacts the outer circumferential surface of the intermediate transfer belt 37*a*, so that the rotating intermediate transfer belt 37*a* rotates the second transfer roller 8. The second transfer roller 8 rotates at the same speed as the intermediate transfer belt 37*a*. Therefore, a driving gear for rotating the second transfer roller 8 is not needed. As a result, an image having banding caused by jitter of the driving gear can be prevented or reduced.

Figure 5:
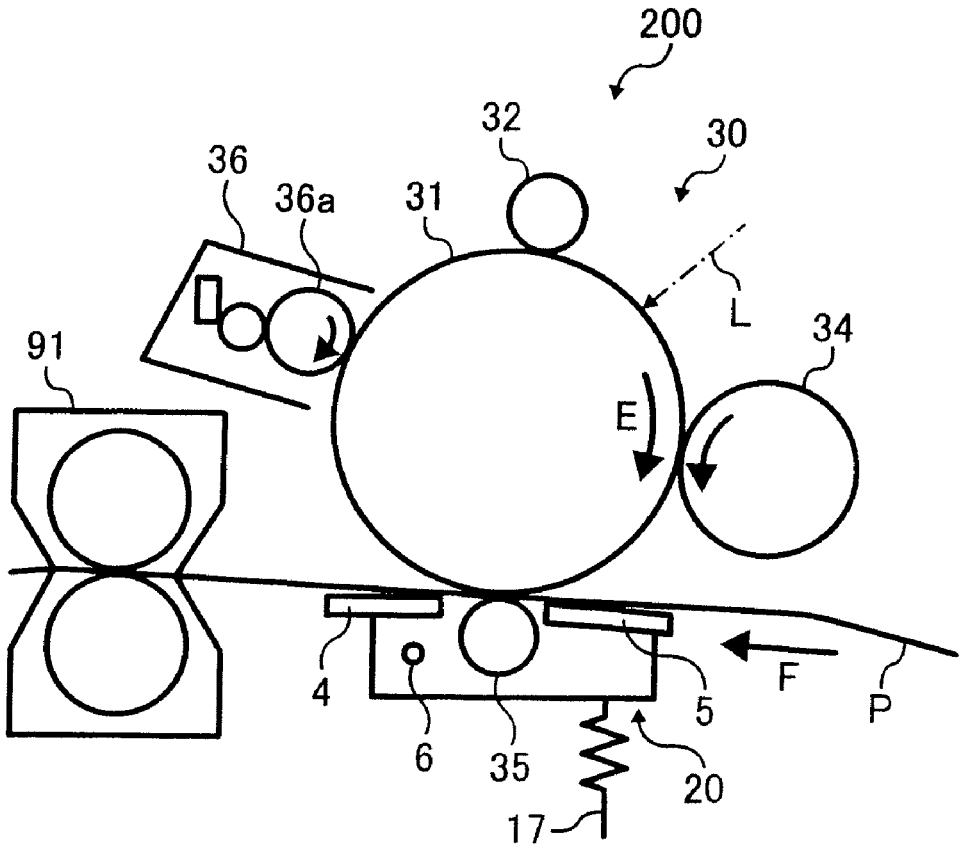
FIG. 5 is a schematic view of an image forming apparatus according to another exemplary embodiment of the present invention.

Referring to FIG. 5, the following describes an image forming apparatus 200 according to another exemplary embodiment of the present invention. In the image forming apparatus 100 according to the previous embodiment, the intermediate transfer belt 37*a* (i.e., an intermediate transfer member) serves as a toner image carrier for carrying a toner image to be transferred onto a recording medium (e.g., a sheet P). In the image forming apparatus 200 according to this non-limiting exemplary embodiment, a photoconductor 31 (i.e., an electrostatic latent image carrier) serves as a toner image carrier for carrying a toner image to be transferred onto a recording medium (e.g., a sheet P).

As illustrated in FIG. 5, the image forming apparatus 200 includes a photoconductor 31, an image forming unit 30, a fixing unit 91, a transfer unit 20, and the spring 17. The image forming unit 30 includes a charger 32, a development unit 34, and a cleaner 36. The cleaner 36 includes a cleaning roller 36*a*. The transfer unit 20 includes a transfer roller 35, the pre-transfer guide 5, the post-transfer guide 4, and the pivot 6.

The image forming apparatus 200 can be a copying machine, a facsimile machine, a printer, a multifunction printer including copying, printing, scanning, and facsimile functions, or the like. According to this non-limiting exemplary embodiment of the present invention, the image forming apparatus 200 functions as a monochrome printer for forming a monochrome image on a recording medium by an electrophotographic method.

The photoconductor 31, serving as an electrostatic latent image carrier and a toner image carrier, has a drum shape and rotates in a rotating direction E at a predetermined speed. The image forming unit 30, serving as an image forming mechanism, forms a toner image according to image data. The charger 32 uniformly charges a surface of the photoconductor 31. An optical writer (not shown) emits light L controlled by image data onto the surface of the photoconductor 31 so as to form an electrostatic latent image on the surface of the photoconductor 31. The development unit 34 develops the electrostatic latent image with a toner to form a toner image.

The transfer unit 20 has a structure similar to the structure of the second transfer unit 1. The pre-transfer guide 5 guides a recording medium (e.g., a sheet P) conveyed in a direction F from a sheet feeding path (not shown) toward the transfer roller 35. The transfer roller 35, serving as a transferor, opposes the photoconductor 31 and transfers the toner image formed on the surface of the photoconductor 31 onto the sheet P. The post-transfer guide 4 guides the sheet P fed by the photoconductor 31 toward the fixing unit 91. The cleaning roller 36*a* of the cleaner 36 removes a residual toner remaining on the surface of the photoconductor 31 after the toner image is transferred onto the sheet P. A discharger (not shown) removes residual electric charge remaining on the surface of the photoconductor 31 after the cleaner 36 cleans the surface of the photoconductor 31. A sheet conveyer (not shown) conveys the sheet P bearing the toner image toward the fixing unit 91. In the fixing unit 91, heat and pressure are applied to the sheet P to fix the toner image on the sheet P. The sheet P bearing the fixed toner image is output onto an output tray (not shown).

The pre-transfer guide 5, the post-transfer guide 4, and the transfer roller 35 are integrally supported in the transfer unit 20. Therefore, the transfer roller 35 contacts and separates to and from the photoconductor 31 when the position of the transfer unit 20 with respect to the photoconductor 31 is changed.

The transfer roller 35 contacts and separates to and from the photoconductor 31 by a movement of the transfer unit 20. Namely, the positions of the pre-transfer guide 5 and the post-transfer guide 4 are fixed with respect to the transfer roller 35. The photoconductor 31 and the transfer roller 35, when contacting with each other, form a transfer nip. The sheet P is stably conveyed on upstream and downstream sides from the transfer nip relative to a sheet conveyance direction. Thus, even when the transfer roller 35 is configured to be movable to contact and separate to and from the photoconductor 31, the sheet P can be stably conveyed.

According to the above-described non-limiting exemplary embodiments, the pre-transfer guide (i.e., the pre-transfer guide 5), the post-transfer guide (i.e., the post-transfer guide 4), and the transferor (i.e., the second transfer roller 8 or the transfer roller 35) are integrally supported in the transfer unit (i.e., the second transfer unit 1 or the transfer unit 20). The contact-separate mechanism moves the transfer unit to contact and separate the transferor to and from the toner image carrier (i.e., the intermediate transfer belt 37*a* or the photoconductor 31). Namely, the pre-transfer guide, the post-transfer guide, and the transferor move together simultaneously. Thus, the positions of the pre-transfer guide and the post-transfer guide with respect to the transferor are fixed.

According to the above-described non-limiting exemplary embodiments, a recording medium (i.e., a sheet P) is stably conveyed on the upstream and downstream sides from the transfer nip (i.e., the second transfer nip or the transfer nip) relative to the sheet conveyance direction. Thus, even when the transferor is configured to be movable to contact and separate to and from the toner image carrier, the recording medium can be stably conveyed.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image forming mechanism configured to form a toner image;

a toner image carrier configured to carry the toner image;

a transfer unit including, a transferor opposing the toner image carrier to form a transfer nip at which the toner image on the toner image carrier is transferred onto a recording medium, a pre-transfer guide that guides the recording medium to the transfer nip and that is disposed on an upstream side from the transfer nip relative to a recording medium conveyance direction, a post-transfer guide that guides the recording medium away from the transfer nip and that is disposed on a downstream side from the transfer nip relative to the recording medium conveyance direction, and a pivot around which the transfer unit is configured to rotate; and a contact-separate mechanism configured to move the transfer unit such that each of the transferor, the pre-transfer guide and the post-transfer guide move together as a single unit from a first position in which the transferor contacts the toner image carrier to a second position in which the transferor is separated from the toner image carrier, the contact-separate mechanism including an elongate hole which engages with the pivot of the transfer unit and through which the pivot is movable in a longitudinal direction of the elongate hole.

2. The image forming apparatus according to claim 1, wherein the toner image carrier is an electrostatic latent image carrier.

3. The image forming apparatus according to claim 1, wherein the toner image carrier is an intermediate transfer member.

4. The image forming apparatus according to claim 1, wherein the transfer unit further includes a consumable unit, the consumable unit including the transferor and being attachable and detachable to and from the transfer unit.

5. The image forming apparatus according to claim 1, wherein the transfer unit further includes an application point to which the contact-separate mechanism applies a force for contacting and separating the transferor to and from the toner image carrier, wherein the pivot is disposed in one end portion of the transfer unit and the application point is disposed in another end portion of the transfer unit in a recording medium conveyance direction, and wherein the transferor is disposed between the pivot and the application point.

6. The image forming apparatus according to claim 5, wherein the longitudinal direction of the elongate hole and a direction of the force for contacting and separating the transferor to and from the toner image carrier form an angle in a range of from about 60 degrees to about 120 degrees.

7. The image forming apparatus according to claim 1, wherein the toner image carrier is included in the image forming apparatus as a toner image carrier unit, and wherein the toner image carrier unit further includes a positioning member configured to position the transferor with respect to the toner image carrier, the toner image carrier unit being attachable and detachable to and from the image forming apparatus.

8. The image forming apparatus according to claim 1, further comprising:

a positioning member configured to position the transferor with respect to the toner image carrier, wherein the positioning member is provided in a main body of the image forming apparatus.

9. The image forming apparatus according to claim 1, wherein the transfer unit is positioned in the image forming apparatus by contacting an element of the transfer unit other than the transferor to an element of the image forming apparatus other than the toner image carrier.

10. The image forming apparatus according to claim 1, wherein the transfer unit is positioned in the image forming apparatus by contacting the transferor of the transfer unit to the toner image carrier.

11. The image forming apparatus according to claim 1, wherein the transferor includes a roller which is rotated by the rotating toner image carrier when an outer circumferential surface of the transferor contacts an outer circumferential surface of the toner image carrier.

12. The image forming apparatus according to claim 1, wherein the pre-transfer guide and the post-transfer guide are fixed relative to the transferor, and wherein the pre-transfer guide and the post-transfer guide each respectively guide the recording medium by making direct contact with the recording medium while the recording medium is conveyed in the recording medium conveyance direction.

13. An image forming apparatus, comprising:

an image forming mechanism configured to form a toner image;

a toner image carrier configured to carry the toner image;

a transfer unit including, a transferor opposing the toner image carrier to form a transfer nip at which the toner image on the toner image carrier is transferred onto a recording medium, a pre-transfer guide that guides the recording medium to the transfer nip and that is disposed on an upstream side from the transfer nip relative to a recording medium conveyance direction, a post-transfer guide that guides the recording medium away from the transfer nip and that is disposed on a downstream side from the transfer nip relative to the recording medium conveyance direction, and a pivot around which the transfer unit is configured to rotate; and means for moving the transfer unit such that each of the transferor, the pre-transfer guide and the post-transfer guide move together as a single unit from a first position in which the transferor contacts the toner image carrier to a second position in which the transferor is separated from the toner image carrier, the means for moving the transfer unit including an elongate hole which engages with the pivot of the transfer unit and through which the pivot is movable in a longitudinal direction of the elongate hole.

14. The image forming apparatus according to claim 13, wherein the pre-transfer guide and the post-transfer guide are fixed relative to the transferor, and wherein the pre-transfer guide and the post-transfer guide each respectively guide the recording medium by making direct contact with the recording medium while the recording medium is conveyed in the recording medium conveyance direction.

15. An image forming apparatus, comprising:

an image forming mechanism configured to form a toner image;

a transfer unit including, a transferor opposing the image forming mechanism to form a transfer nip at which the toner image on the image forming mechanism is transferred onto a recording medium, a pre-transfer guide that guides the recording medium to the transfer nip and that is disposed on an upstream side from the transfer nip relative to a recording medium conveyance direction, a post-transfer guide that guides the recording medium away from the transfer nip and that is disposed on a downstream side from the transfer nip relative to the recording medium conveyance direction, and a pivot around which the transfer unit is configured to rotate; and a contact-separate mechanism configured to move the transfer unit such that each of the transferor, the pre-transfer guide and the post-transfer guide move together as a single unit from a first position in which the transferor contacts the image forming mechanism to a second position in which the transferor is separated from the image forming mechanism, the contact-separate mechanism including an elongate hole which engages with the pivot of the transfer unit and through which the pivot is movable in a longitudinal direction of the elongate hole.

16. The image forming apparatus according to claim 15, wherein the transfer unit further includes a consumable unit, the consumable unit including the transferor and being attachable and detachable to and from the transfer unit.

17. The image forming apparatus according to claim 15, wherein the transfer unit further includes, an application point to which the contact-separate mechanism applies a force for contacting and separating the transferor to and from the image forming mechanism, wherein the pivot is disposed in one end portion of the transfer unit and the application point is disposed in another end portion of the transfer unit in a recording medium conveyance direction, and wherein the transferor is disposed between the pivot and the application point.

18. The image forming apparatus according to claim 17, wherein the longitudinal direction of the elongate hole and a direction of the force for contacting and separating the transferor to and from the image forming mechanism form an angle in a range of from about 60 degrees to about 120 degrees.

19. The image forming apparatus according to claim 15, wherein the pre-transfer guide and the post-transfer guide are fixed relative to the transferor, and wherein the pre-transfer guide and the post-transfer guide each respectively guide the recording medium by making direct contact with the recording medium while the recording medium is conveyed in the recording medium conveyance direction.

* * * * *